US006410199B1

(12) United States Patent
Ikeuchi et al.

(10) Patent No.: US 6,410,199 B1
(45) Date of Patent: Jun. 25, 2002

(54) IMAGE RECEIVING SHEET AND RECORDING PROCESS

(75) Inventors: Nobuho Ikeuchi, Tokyo; Masafumi Hayashi, Sayama, both of (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 09/429,649

(22) Filed: Oct. 29, 1999

(30) Foreign Application Priority Data

Oct. 29, 1998 (JP) ..... 10-308537

(51) Int. Cl.[7] ..... B41M 5/00
(52) U.S. Cl. ..... 430/124; 428/195; 428/913
(58) Field of Search ..... 428/195, 913, 428/914; 430/124

(56) References Cited

U.S. PATENT DOCUMENTS

| | | | |
|---|---|---|---|
| 5,102,737 A | 4/1992 | Josephy et al. | 428/411.1 |
| 5,208,093 A | 5/1993 | Carls et al. | 428/195 |
| 5,229,188 A | 7/1993 | Takeuchi et al. | 428/195 |
| 5,352,553 A | 10/1994 | Takeuchi et al. | 430/42 |
| 5,482,760 A | 1/1996 | Takeuchi | 428/195 |

FOREIGN PATENT DOCUMENTS

| | | |
|---|---|---|
| JP | 5-80586 | 4/1993 |
| JP | 5-27479 | 5/1993 |
| JP | 8-194394 | 7/1996 |
| JP | 8-305066 | 11/1996 |
| JP | 8-334916 | 12/1996 |
| JP | 2633023 | 4/1997 |

*Primary Examiner*—Bruce H. Hess
(74) *Attorney, Agent, or Firm*—Morgan Lewis & Bockius LLP

(57) ABSTRACT

An image receiving sheet is provided for superior image reproduction. The image receiving sheet include a substrate and a receptor layer over at least one side of said substrate. The receptor layer includes a resin binder. The storage elasticity modulus of the resin binder is equal to or greater than $10^6$ Pa at temperatures below about 40° C. and substantially satisfies the following relationships: $G'_{130}/G'_{200} \leqq 9.0$ and $G'_{130} \leqq 10^3$ Pa, where $G'_{130}$ is the storage elasticity modulus of the resin binder at 130° C. and $G'_{200}$ is the storage elasticity modulus of the resin binder at 200° C.

16 Claims, 2 Drawing Sheets

IMAGE RECEIVING SHEET AND RECORDING PROCESS

This application claims the benefit of Japanese Application No. 10-308537, filed in Japan on Oct. 29, 1998, which is hereby incorporated by reference.

This application also incorporates by reference Japanese Patent No. 2633023 and Japanese Unexamined Laid-Open Publication Nos. 08-194394, 08-334916, 08-305066, 05-27479, and 05-80586.

BACKGROUND OF THE INVENTION

1. Field of the Invention

This invention relates to an image receiving sheet for electrophotographic recording of images. More particularly, the present invention relates to a transparent image receiving sheet that can be used in an overhead projector.

2. Discussion of the Related Art

Full color image forming processes using electrophotography have come into practice. In these processes, images are electrophotographically formed on an image receiving sheet through mixture of toners of three colors: yellow, magenta and cyan, or mixture of toners of four colors: black in addition to these three colors.

To record and hold information, such as lines, letters, pictures, etc., with sufficient reliability, the image receiving sheet is generally composed of a substrate and a receptor layer formed on the substrate. Such an image receiving sheet is used in an overhead projector, for example, as an information transmission device for use in lecture meetings and other various presentations and exhibitions in schools, industries, etc.

However, when a full color image formed by electrophotography is projected through an overhead projector, the projected image exhibits a gray tone (graying), resulting in an undesirably narrow color-tone reproduction range. Toner particles attached to a smooth image receiving surface of the conventional image receiving sheet are often not sufficiently embedded into the receptor layer of the image receiving sheet by heat applied in fixation of the toners. As a result, portions of the toner particles protrude from the surface of the sheet and the surface of the image receiving sheet becomes uneven. Such protruded portions scatters incident light when an image is projected by an overhead projector, resulting in creation of a shadow over a screen onto which the image is projected.

One attempt to solve this graying problem is disclosed in Japanese Patent No. 2633023. The Japanese Patent proposes use of a receptor layer resin having a storage elasticity modulus, which ranges from 100 to 10000 dyne/cm$^2$ at 160° C., and which is higher than that of toner resin at a toner fixing temperature. The fixing temperatures in current electrophotography techniques, however, widely vary from 140° C. to 195 ° C. depending on the type of apparatus. Thus, this requirement on the storage elasticity modulus at 160° C. is not sufficient to produce clear projected images. Further, when the receptor resin having a larger storage elasticity modulus than that of the toner resin at the tone fixation temperature is used, the toners cannot be sufficiently embedded in such a receptor layer.

For similar reasons, requirements on the relationship between the storage elasticity modulus of the receptor resin and that of the toner at 150° C., as disclosed in Japanese Unexamined Laid-Open Publication No. 8-194394, are inadequate to provide for a sufficient image quality under practical conditions.

Japanese Unexamined Laid-Open Publication No. 8-334916 states that the storage elasticity modulus ($E_p$) of a transparent receptor layer of a polyester resin desirably has the following relationship to the storage elasticity modulus ($E_t$) of a toner resin to be fixed:

$$-50 \leqq (E_p - E_t) \leqq 2500 \text{(unit: Pa)}.$$

However, the present inventors discovered through various experiments that a receptor layer having a storage elasticity modulus lower than that of the toner resin is more desirable. This is because such a receptor resin is applicable to a variety of electrophotographic copying machines and printers, and accordingly has a wider applicability.

Japanese Unexamined Laid-Open Publication No. 8-305066 specifies the storage elasticity modulus of a receptor layer containing a styrene-butadiene block copolymer in the range of 140° C. to 200° C. However, because polyester resins are predominantly used as toner resins, this type of receptor layer has a poor compatibility with toners and therefore is not suitable for producing clear projected images.

SUMMARY OF THE INVENTION

Accordingly, the present invention is directed to an image receiving sheet and a recording process that substantially obviate the problems due to limitations and disadvantages of the related art.

An object of the present invention is to provide an image receiving sheet that possesses a satisfactory color tone reproducibility and accordingly can generate a clear projected image substantially free from graying.

Another object of the present invention is to provide an image receiving sheet that has a superior image reproducibility and is usable in a variety of electrophotographic copying machines and printers of different manufactures with various fixation temperatures, thereby providing a high quality image receiving sheet having a wide variety of usages.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides, in a first aspect, an image receiving sheet including a substrate and a receptor layer formed on at least one side of the substrate, wherein the storage elasticity modulus of a resin binder in the receptor layer is equal to or greater than about $10^6$ Pa in a temperature range below about 40° C., and substantially satisfies the following relationships:

$$G'_{130}/G'_{200} \leqq 9.0$$

and $$G'_{130} \leqq 10^3 \text{ Pa},$$

where $G'_{130}$ is the storage elasticity modulus at 130° C. and $G'_{200}$ is the storage elasticity modulus at 200° C.

According to this aspect of the present invention, toners attached to a smooth image receiving surface of the image receiving sheet can sufficiently be embedded in the receptor layer by heat applied during fixation of the toner, and the toners are compatible with the receptor layer at their boundary surfaces. As a result, the surface of the resultant image receiving sheet can be made sufficiently smooth.

A preferable range of the thickness of the receptor layer is about 0.1 $\mu$m to about 10.0 $\mu$m.

More preferably, in electrophotographic recording, the storage elasticity modulus $G'_A$ of a toner resin of a toner to be attached to the image receiving sheet substantially satisfies the following relationship with the storage elasticity modulus $G'_B$ of the resin binder in the receptor layer at temperatures ranging from about 130° C. to about 200° C.:

$$0.1 \leqq G'_A/G'_B \leqq 2500.$$

In this case, even better embedment of the toner into the receptor layer can be achieved.

It is also preferable that the resin binder of the receptor layer include at least one of epoxy resins and polyester resins having a bisphenol A skeleton.

The image receiving sheet preferably has a parallel ray transmittance equal to or greater than about 70%.

In another aspect, the invention provides an electrophotographical recording method including the step of fixing a toner on the aforementioned image receiving sheet at a surface temperature of a fixing roller ranging from about 130° C. to about 200° C.

According to these aspects, an image receiving sheet of the present invention possesses a satisfactory color tone reproducibility and accordingly can generate a clear projected image substantially free from graying. Moreover, it can be used in a variety of electrophotographic copying machines and printers of different manufactures with various fixation temperatures, thereby providing a high quality image receiving sheet having a wide variety of usages.

In another aspect, the present invention provides an image receiving sheet including a substrate and a receptor layer over at least one side of said substrate, the receptor layer including a resin binder, the storage elasticity modulus of the resin binder being equal to or greater than $10^6$ Pa at temperatures below about 40° C. and substantially satisfying the following relationships: $G'_{130}/G'_{200} \leqq 9$ and $G'_{130} \leqq 10^3$ Pa, where $G'_{130}$ is the storage elasticity modulus of the resin binder at 130° C. and $G'_{200}$ is the storage elasticity modulus of the resin binder at 200° C.

In another aspect, the present invention provides a method for recording an image onto an image receiving sheet, the method including the steps of providing an image receiving sheet, the image receiving sheet including a substrate; and a receptor layer over at least one side of said substrate, the receptor layer including a resin binder, the storage elasticity modulus of the resin binder being equal to or greater than $10^6$ Pa at temperatures below about 40° C. and substantially satisfying the following relationships: $G'_{130}/G'_{200} \leqq 9$ and $G'_{130} \leqq 10^3$ Pa, where $G'_{130}$ is the storage elasticity modulus of the resin binder at 130° C. and $G'_{200}$ is the storage elasticity modulus of the resin binder at 200° C.; transferring toner particles onto the receptor layer to form a pattern of the toner particles corresponding to the image to be recorded on the image receiving sheet; and embedding the toner particles into the reception layer at a predetermined fixing temperature to fix the toner particles to the image receiving sheet, the predetermined temperature being within the range of about 130° C. to about 200° C.

In a further aspect, the present invention provides a method for recording an image onto an image receiving sheet, the method including the steps of providing an image receiving sheet, the image receiving sheet including a substrate and a receptor layer over at least one side of said substrate, the receptor layer including a resin binder; transferring toner particles onto the receptor layer to form a pattern of the toner particles corresponding to the image to be recorded on the image receiving sheet, each of the toner particles including a toner resin; and embedding the toner particles into the reception layer at a predetermined fixing temperature to fix the toner particles to the image receiving sheet, wherein the storage elasticity modulus $G'_A$ of the toner resin in each of the toner particles and the storage elasticity modulus $G'_B$ of the resin binder in the receptor layer substantially satisfy the following relationship at the predetermined fixing temperature: $0.1 \leqq G'_A/G'_B \leqq 2500$.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
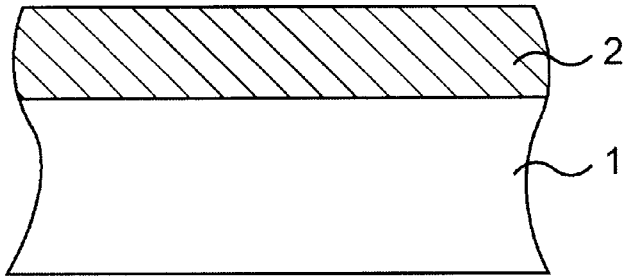
FIG. 1 is a cross-sectional view schematically showing an image receiving sheet according to a preferred embodiment of the invention.

FIG. 1 shows a preferred embodiment of the present invention. The image receiving sheet of the present embodiment includes a substrate 1 and a receptor layer 2 formed on one side of the substrate 1. The image receiving sheet of the present invention is configured such that when an image is formed and fixed on the image receiving sheet by an electrophotographic copying machine or printer, the resulting surface of the sheet can be made sufficiently smooth so as to avoid undesirable scattering of light that causes graying.

Figure 4:
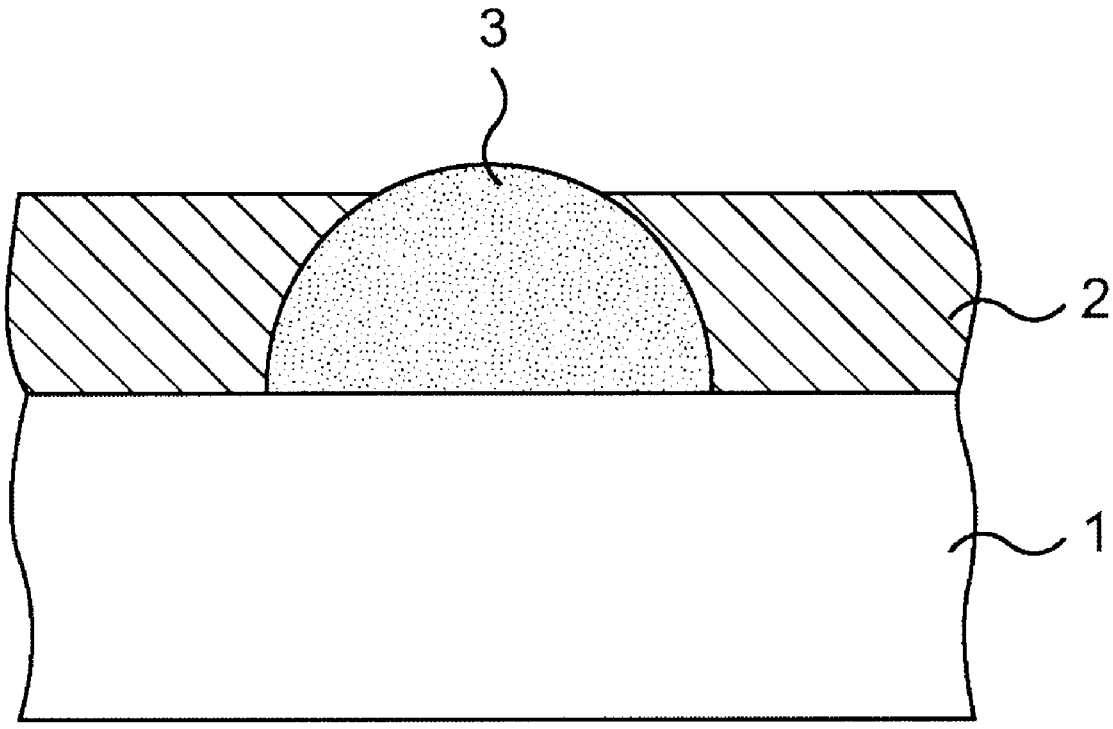
FIG. 4 is a schematic cross-sectional view showing the state where a toner is embedded in a receptor layer in the image receiving sheet of the present invention.

FIG. 4 shows a cross-sectional view of the image receiving sheet of the present invention after the image forming (fixing) process. A toner 3 is attached to a smooth surface of the image receiving sheet, and is sufficiently embedded in the receptor layer 2 via heat applied for fixing. The toner 3 and the receptor layer 2 are compatible with each other in their boundary surfaces, and as a result, the upper surface of the sheet is substantially smoothed out, as shown in FIG. 4.

Figure 2:
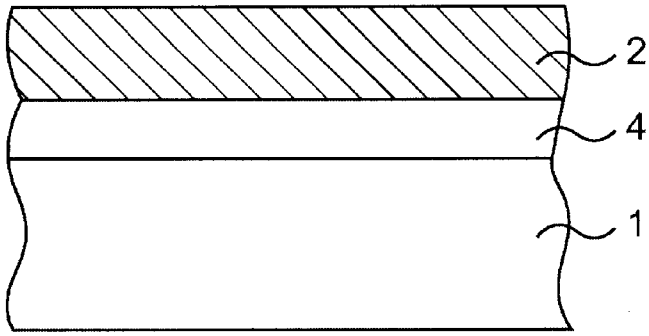
FIG. 2 is a cross-sectional view schematically showing an image receiving sheet according to another preferred embodiment of the invention.

As shown in FIG. 2, which illustrates another preferred embodiment of the image receiving sheet according to the present invention, a primer layer 4 may be formed between the substrate 1 and the receptor layer 2 to enhance adhesion between the substrate 1 and the receptor layer 2.

Figure 3:
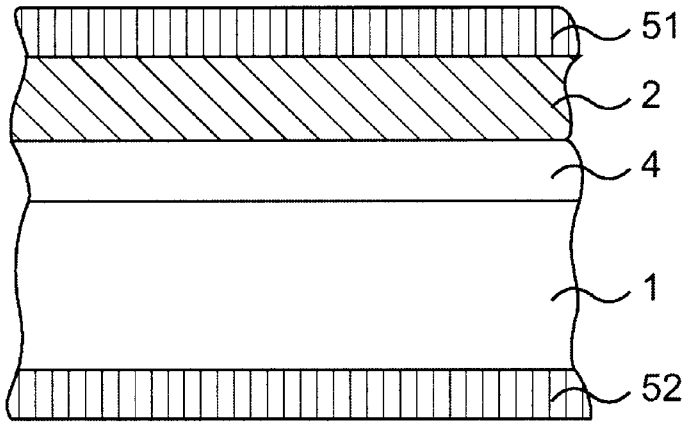
FIG. 3 is a cross sectional view schematically showing an image receiving sheet according to a further preferred embodiment of the invention.

As shown in FIG. 3, which illustrates still another preferred embodiment of the image receiving sheet according to the present invention, the image receiving sheet may further include anti-static layers (charge control layers) 51, 52 at the outermost surfaces of the sheet to control the surface electric resistivity of the image receiving sheet. The charge control layers can be formed with any conventional charge control agents.

Next, each component of the image receiving sheet of the preferred embodiments referred to above is described in more detail.

Substrate

When recorded images are to be projected via transmission of light rays through the image receiving sheet, as in the case of an overhead projector sheet, the substrate 1 preferably is formed of a thermoplastic resin having superior characteristics in terms of transparency, heat-resistance, and dimensional stability and rigidity.

Examples of such materials include, but are not limited to, polyethyleneterephthalate resins, polyethylenenaphthalate resins, polycarbonate resins, acrylic resins, polyvinylchloride resins, polypropylene resins, polystyrene resins, polyethylene resins, cellulose diacetate resins, and cellulose triacetate resins. A film or sheet made of any of these resins having a thickness ranging from about 10 $\mu$m to about 250 $\mu$m, and more preferably from about 50 $\mu$m to about 180 $\mu$m, is suitable for use as the substrate. Among these resins, polyethylene terephthalate resins are particularly preferable in terms of the characteristics mentioned above.

In this transmission type image receiving sheet, an overall parallel ray transmittance of the sheet including the substrate and the receptor layer (and other additional layers, such as a back layer, etc., if desired) preferably is equal to or more than about 70% in order to produce high quality transmitted images.

On the other hand, when recorded images are to be displayed by reflection of light from the image receiving sheet, it is preferable to use a substrate that is opaque, such as white or other color, by adding a coloring agent, for example. In this case, the substrate may be plain paper, coated paper, a plastic film, plastic-based synthetic paper, or the like. When a semi-transparent substrate is used, the image receiving sheet can also be used for illumination purposes.

Further, for the purpose of enhancing adhesion of the substrate with a layer formed on the substrate, the surface of the substrate may be provided with a primer layer (FIGS. 2 and 3), or treated by other conventional adhesion enhancement methods, such as a corona discharge treatment.

Receptor Layer

The image receiving sheet of the present invention has a receptor layer formed on at least one side of the substrate. In the present invention, the storage elasticity modulus of a resin binder in the receptor layer is equal to or greater than about $10^6$ Pa in a temperature range below about 40° C. and further substantially satisfies the following relationships:

$$G'_{130}/G'_{200} \leqq 9.0$$

and $$G'_{130} \leqq 10^{3}\ \text{Pa},$$

where $G'_{130}$ is the storage elasticity modulus at 130° C. and $G'_{200}$ is the storage elasticity modulus at 200° C. Therefore, the storage elasticity modulus of the resin binder of the receptor layer exhibits less changes and is stable in the range of 130° C. to 200° C. This temperature range approximately corresponds to the heating temperature range for fixation of toners in almost all of currently available electrophotographic machines (copiers, printers, etc.). With the storage elasticity modulus specified above, the toner attached to the image receiving surface can be sufficiently embedded in the receptor layer by heat applied during fixation, thereby achieving a smooth surface profile of the image receiving layer upon toner fixation. Accordingly, the image receiving sheet of the present invention can be used in a variety of electrophotographic copying machines and printers of different manufactures with various fixation temperatures, providing a high quality image receiving sheet with a significantly improved applicability.

The limitation on the storage elasticity modulus, "equal to or greater than about $10^6$ Pa in a temperature range below about 40° C.," is preferable because with such a storage elasticity modulus in that temperature range, which is around a room temperature and above, undesirable stickiness of the image receiving sheet can be significantly reduced or eliminated, thereby facilitating handling of the image receiving sheet and securing proper storage of a stack of multiple sheets without adhesion to each other.

As described above, according to this aspect of the present invention, the storage elasticity modulus of the resin is specified. The storage elasticity modulus can be measured by a Dynamic Spectrometer ARES made by Rheometrics. The measured storage elasticity modulus may be calibrated using the least squares method, for example.

A resin used in the receptor layer preferably has a good compatibility with toners. Examples of such resins suited for the resin binder in the receptor layer include, but are not limited to, polyolefin resins, such as polyethylene and polypropylene; vinyl resins, such as polyvinylchloride, polyvinylidene chloride, polyvinylacetate, vinylchloride-vinylacetate copolymers, polyacrylates, and polystyrene; polyester resins obtained by condensation polymerization of a diol having a bisphenol skeleton or alkylene skeleton with divalent or trivalent carboxylic acid; polyamide-type resins; copolymers-of olefin, such as ethylene or propylene, and another vinyl monomer; ionomers; cellulosic resins, such as ethylcellulose and celluloseacetate; polycarbonate resins; epoxy resins; and phenoxy resins. Here, the phenoxy resins are synthesized essentially from epichlorohydrin and bisphenol, and have no reactive epoxy groups at ends. More specifically, the phenoxy resins are synthesized from a high-purity bisphenol A and epichlorohydrin at a mole ratio of 1:1, or from a high-purity bisphenol A diglycidylether and bisphenol at a mole ratio of 1:1.

The above resins preferably have a softening point within the range of about 30° C. to about 200° C. The use of a resin having a softening point lower than about 30° C. is undesirable from the viewpoint of storage stability, and may cause a so-called "blocking," which denotes the phenomena that when a plurality of image receiving sheets are piled up, the receptor layer is adhered to the contacting surfaces. On the other hand, if the softening point exceeds about 200° C., image formation (fixation of the toner) requires too much energy.

As toner resins, polyester resins having a bisphenol A skeleton is popularly used. Accordingly, the use of an epoxy resin or a polyester resin that has a bisphenol A skeleton as the resin binder of the receptor layer is preferred because of their superior compatibility with toner resins and better fixity. Next, such epoxy resins and polyester resins are described in more details.

Polyester resins containing, as a diol component, bisphenol A modified with ethyleneglycol or propyleneglycol exhibit a particularly better toner fixity. There is no specific limitation to the acid component in such polyester resins. Examples of the suitable acid component include, but are not limited to, fumaric acid, phthalic acid, terephthalic acid, isophthalic acid, maleic acid, succinic acid, adipic acid, citraconic acid, itaconic acid, sebacic acid, malonic acid, hexacarbonic acid, and trimellitic acid.

Of these polyester resins, resins that are made of bisphenol A modified with is propyleneglycol or ethyleneglycol, as a diol component, and fumaric acid, maleic acid, terephthalic acid, or trimellitic acid, as an acid component have good compatibility with toner resins, and have satisfactory toner fixing and wetting properties, thereby being capable of producing high quality images.

Epoxy resins are resins formed by a ring-opening reaction of epoxy groups in polymers each having two or more epoxy groups therein. They are obtained essentially by reacting epichlorohydrin with a compound having active hydrogen and then dehydrochlorinating the product. An epoxy resin having a weight per epoxy equivalent equal to or greater than about 500 g is particularly preferable for prevention of "blocking."

In a preferred embodiment of the invention, the storage elasticity modulus $G'_A$ of the toner resin substantially satisfies the following relationship with the storage elasticity modulus $G'_B$ of the resin binder of the receptor layer at temperatures between 130° C. and 200° C.:

$$0.1 \leqq G'_A/G'_B \leqq 2500$$

This means that the storage elasticity modulus $G'_A$ of the toner resin is 0.1 to 2500 times as much as the storage elasticity modulus $G'_B$ of the resin binder of the receptor layer at temperatures ranging from 130° C. to 200° C. This temperature range approximately corresponds to the heating temperature range during fixation of toners in currently available electrophotographic machines (copiers, printers, etc.). Therefore, the storage elasticity modulus of the resin binder of the receptor layer is comparatively low.

Under the above conditions, the toner attached to the image receiving surface can be sufficiently and adequately embedded in the receptor layer. Thus, the image receiving sheet of the present invention is applicable to a variety of electrophotographic copying machines and printers of different manufactures, and in particular, can produce a clear projected image substantially free from graying when used in an overhead projector, providing for a satisfactory color-tone reproducibility.

The resin binder of the receptor layer may further includes a variety of additives such as fillers, conductive substances, and peeling agents, as long as they do not adversely affect the transparency of the receptor layer.

As the filler, either one of, or both of, an organic filler and an inorganic filler can be used to enhance ease in handling and feeding the sheets (sheet feeding property). Examples of the organic fillers that can be used include, but are not limited to, fluororesins, such as ethylenetetrafluoride resins and ethylene-ethylene tetrafluoride copolymers; polyethylene resins; polystyrene resins; acrylic resins; polyamide resins; benzoguanamine resins; and other organic resins. Examples of the inorganic fillers that can be used include, but are not limited to, silica, colloidal silica, alumina, kaolin, clay, calcium carbonate, talc, and titanium dioxide.

Preferably, the average particle size of the filler to be added is within the range of about 0.1 $\mu$m to about 10 $\mu$m and is larger than the thickness of the receptor layer. Smaller particles, i.e., less than 0.1 $\mu$m in average particle size, are not preferable because they cannot properly realize intended advantages. Larger particles, i.e., exceeding 10 $\mu$m in average particle size, are not preferable because they cannot be properly held in the receptor layer.

The content of the filler preferably falls in the range from about 0.1% to about 10% by weight relative to the resin in the receptor layer. A filler content larger than this range deteriorates the transparency. When high transparency is particularly required, the upper limit of the content should preferably be about 5% by weight to suppress haze to 10 or less. On the other hand, a fewer content of the filler fails to improve ease in handling and feeding the sheet (sheet feeding property).

Conductive substances that can be added to the receptor layer include conductive polymeric materials and metal oxides. Examples of the conductive polymeric materials include, but are not limited to, sulfonated polyaniline, chemically doped polyacetylene, poly-p-phenylene-vinylene, poly-p-phenylenesulfide, chemically polymerized and doped polypyrrole, polythiophene, polyaniline, heat treated products of phenol resins, heat treated products of polyamide, and heat treated products of perillenic anhydride. Among them, sulfonated polyaniline and polythiophene are particularly preferable.

Examples of the metal oxides that can be added to the receptor layer as the conductive substance include, but are not limited to, zinc oxide (ZnO), tin oxide ($SnO_2$), indium oxide ($In_2O_3$), and titanium oxide ($TiO_2$). These metal oxides may further include a dopant. As such a dopant, aluminum (Al) or antimony (Sb) for Zn, antimony (Sb) for Sn, or tin (Sn) for $In_2O_3$ is generally used. Each of these metal oxides can be used singly or in combination. The metal oxides may be covered with $SnO_2$ or Sb-doped $SnO_2$.

Particularly preferred metal oxides to be used in the image receiving sheet of the invention are $SnO_2$ and $SnO_2$-coated metal oxides, and especially Sb-doped $SnO_2$ because of their satisfactory coating suitability, stability in surface electric resistivity, metallic electric conductivity, and costs.

Shapes of the metal oxides are not limited to a spherical shape, and may be needle crystal. Spherical metal oxides preferably have a primary particle size of from about 10 nm to about 1000 nm. Needle crystalline metal oxides preferably have a fiber length of about 0.1 $\mu$m to about 2 $\mu$m and an aspect ratio within the range of about 10 to about 50. The use of such needle-shape metal oxides having these dimensions improves the transparency of the receptor layer, and enhance the quality of transmitted images when the image receiving sheet is used for observation of recorded images by transmitted light as in an overhead projector.

When a coating composition is prepared for the receptor layer using the metal oxide, the ratio of the metal oxide to the thermoplastic resin preferably falls within the range from about 0.2 to about 2.0. If the ratio is less than 0.2, the amount of the metal oxide is insufficient, and the surface electric resistivity of the receptor layer is not stabilized. On the other hand, if the ratio exceeds about 2.0, the inherent color of the metal oxide becomes more recognizable, which is not desirable. This occurs particularly in the case of Sb-doped $SnO_2$. To be more specific, when Sb-doped $SnO_2$ is used in an excess amount, bluish color on the surface of the layer becomes more apparent.

These conductive substances are usually used as water dispersion systems, and the resin binder to be used in the receptor layer is preferably dispersed in water to blend the conductive substances therein. In this case, the resin binder of the receptor layer is generally dispersed in water by dissolving the resin in a ketone-based solvent, adding a dispersant and water to the solution and then removing the solvent.

The receptor layer may further include peeling agents, such as various surfactants, waxes, and oils, in addition to the above fillers and conductive substances, as long as they do not adversely affect the advantages of the present invention.

The receptor layer can be formed by applying a coating composition containing the resin binder component, and, if desired, a variety of additives, as described above, using a conventional printing method, such as gravure printing or silk screen printing, or using a conventional coating method, such as gravure coating. The thickness of the receptor layer preferably is within the range of about 0.05 μm to about 10.0 μm, and more preferably about 0.1 μm to about 10.0 μm. A thickness that is smaller than that range invites a gray tone of a projected image when such an image receiving sheet is applied to an overhead projector, because the toner attached to the surface of the sheet would not be sufficiently embedded in the receptor layer. On the other hand, if the thickness exceeds 10.0 μm, offset due to cohesive failure of the receptor layer is likely to occur, and the image receiving sheet may adhere to a fixing roller, for example, when it is conveyed in a printer.

Instead of adding a conductive agent to the receptor layer, an anti-static layer (resistance control layer) may be formed on the receptor layer or on both of the outermost surfaces of the image receiving sheet. Examples of materials suitable for such an anti-static layer (resistance control layer) include, but are not limited to, fine particles of metals, such as tin oxide and zinc oxide; conductive polymers, such as polythiophene and polyaniline; and binder resins.

Back Layer

The image receiving sheet of the present invention having the receptor layer on at least one side of the substrate may further include a back layer formed on the other side of the substrate. Such a back layer may contain a filler or the Si group. To further improve ease in handling and feeding the sheet (feeding property) and to protect the image receiving sheet from curling with respect to the receptor layer on the front surface of the sheet, the back layer may be formed on the surface opposite to the front surface on which the receptor layer is formed. In addition, if the back layer may be adapted to possess an image receiving capability similar to that of the receptor layer on the front surface of the substrate, either face of the sheet can be used to receive images, which also enables double side image recording.

Examples of materials that can be used for the back layer include, but are not limited to, acrylic resins, polyester resins, urethane resins, and silicone group-added thermoplastic resins, such as silicone-modified acrylic resins, silicone-modified urethane resins, and silicone-modified polyester resins. In addition, other thermoplastic resins, such as graft copolymers containing at least one peeling component in a main chain of a binder resin can also be used. Examples of such a peeling component include, but are not limited to, a polysiloxane segment, a carbon fluoride segment, and a long-chain alkyl segment. Examples of such a binder resin include, but are not limited to, acrylic, vinyl, polyester, polyurethane, polyamide, and cellulosic resins.

The back layer can be formed by applying a composition containing the aforementioned resin, an organic or inorganic filler, and, if desired, a variety of additives, using any conventional coating methods as in the case of the receptor layer. The back layer preferably has a thickness of about 0.01 μm to about 10.0 μm to provide for sufficient advantages.

Examples of materials that can be used as such organic fillers include, but are not limited to, fluororesins, such as fethylene tetrafluoride resins and ethylene-ethylene tetrafluoride copolymers, polyethylene resins, polystyrene resins, acrylic resins, polyamide resins, and benzoguanamine resins. Examples of materials that can be used as such inorganic fillers include, but are not limited to, silica, colloidal silica, alumina, kaolin, clay, calcium carbonate, talc, and titanium dioxide.

Toner

Toners used in image formation in electrophotography are prepared by melting and kneading a resin, a coloring agent, a charge control agent and the like, and crushing (grinding) and classifying the mixture. Recently, polymeric toners are also used.

For example, as the toner resin, polyester resins obtained using, as a diol component, bisphenol A modified with ethyleneglycol or propyleneglycol shown by the following formula can be used:

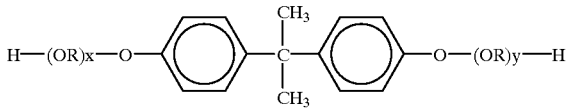

where R is the ethylene group or propylene group, and x and y each independently represent an integer equal to or greater than 1, provided that the average of x plus y is 2 to 7. This modified bisphenol A is disclosed in Japanese Unexamined Laid-Open Publication No. 5-27479, which is hereby incorporated by reference. Examples of the acid component to be co-condensed and polymerized with the diol component include, but are not limited to, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid.

As the toner resin, polyester resins obtained by co-condensing and polymrerizing a linear polyester or linear polyester having a side chain with a carboxylic acid having a valency of 3 or more and/or alcohol having a valency of 3 or more may also be used. Such toner resins are disclosed in Japanese Unexamined Laid-open Publication No. 5-80586, which is hereby incorporated by reference.

The toner resin may further include a styrene resin or a styrene-acrylic resin in addition to the polyester resin as described above.

Examples of the coloring agents that can be used in the toner include various dyes and pigments. Negative-charged charge control agents, such as metal-containing azo dyes, or positive-charged charge control agents may be used.

The toner may further include polymeric fine particles, such as copolymers of acrylic-vinyl monomer, or hydrophobic silica fine powder in order to control electric resistance or charges and to improve the cleaning property of the toner. It may further include waxes and other characteristic improving agents to prevent offset in the preparation of toner.

Preferably, the storage elasticity modulus $G'_A$ of the toner resin substantially satisfies the following relationship with the storage elasticity modulus $G'_B$ of the resin binder of the receptor layer at temperatures ranging from about 130° C. to about 200° C., which are typical heating temperatures employed in fixation of toners:

$$0.1 \leqq G'_A/G'_B \leqq 2500$$

When this relationship is substantially satisfied, the toner is more effectively embedded in the receptor layer, and the image receiving sheet is applicable to almost all types of currently available electrophotographic copying machines and printers of different manufactures and can produce a clear projected image substantially free from graying when used in an overhead projector, resulting in satisfactory color-tone reproducibility.

As described above, the image receiving sheet of the present invention includes a substrate and a receptor layer formed on at least one side of the substrate, and the storage elasticity modulus of a resin binder constituting the receptor layer is equal to or greater than about $10^6$ Pa in a temperature range below about 40° C., and substantially satisfies the following relationships:

$$G'_{130}/G'_{200} \leqq 9.0$$

and $$G'_{130} \leqq 10^3 \text{ Pa},$$

where $G'_{130}$ is a storage elasticity modulus at 130° C. and $G'_{200}$ is a storage elasticity modulus at 200° C. Therefore, the toner attached to a smooth image receiving surface of the image receiving sheet is sufficiently embedded in the receptor layer through heat applied during fixation of the toner, and is compatible with the receptor layer at their boundary surfaces. As a result, the surface of the image receiving sheet is substantially smoothed out.

In electrophotographic recording, even better embedment of the toner into the receptor layer can be achieved when the storage elasticity modulus $G'_A$ of a toner resin substantially satisfies the following relationship with the storage elasticity modulus $G'_B$ of the resin binder of the receptor at temperatures between about 130° C. and about 200° C.:

$$0.1 \leqq G'_A/G'_B \leqq 2500.$$

Thus, the image receiving sheet of the present invention can be used for general purpose use, and is applicable to a variety of electrophotographic copying machines and printers of different manufactures. In particular, the image receiving sheet of the present invention can produce a clear projected image substantially free from graying when used in an overhead projector, providing a satisfactory image-tone reproducibility.

WORKING EXAMPLE 1

The present invention will now be described in further detail with reference to working examples and comparative examples. These examples are exemplary and explanatory, and are not intended to limit the scope of the present invention to particular components and combinations disclosed in the examples. In the following descriptions, "parts" and "%" are by weight unless otherwise specified.

Using a substrate and a coating composition 1 for the receptor layer, which are respectively specified below, an image receiving sheet of Working Example 1 was prepared by applying the coating composition 1 onto one side of the substrate with a thickness of 3.0 μm.

Substrate

Polyethyleneterephthalate film of 100 μm in thickness

| Coating Composition 1 | |
|---|---|
| Resin A | 30 parts |
| Methyl ethyl ketone | 35 parts |
| Toluene | 35 parts |
| Silica (average particle size 5 μm) | 0.05 part |

Here, the resin A is a polyester resin composed of terephthalic acid and ethylene oxide-modified bisphenol A. The resin A has the storage elasticity modulus at 130° C., $G'_{130}$, of 31 and the storage elasticity modulus at 200° C., $G'_{200}$, of 6, the ratio $G'_{130}/G'_{200}$ being 5.2.

WORKING EXAMPLE 2

An image receiving sheet was prepared in the same manner as in Working Example 1 except that a coating composition 2 specified below was used instead of coating composition 1.

| Coating Composition 2 | |
|---|---|
| Resin B | 30 parts |
| Methylethylketone | 35 parts |
| Toluene | 35 parts |
| Silica (average particle size 5 μm) | 0.05 part |

Here, the resin B is a polyester resin composed of terephthalic acid and ethylene glycol. The resin B has the storage elasticity modulus at 130° C., $G'_{130}$, of 10 and the storage elasticity modulus at 200° C., $G'_{200}$, of 19, the ratio $G'_{130}/G'_{200}$ being 0.53.

WORKING EXAMPLE 3

An image receiving sheet was prepared in the same manner as in Working Example 1 except that a coating composition 3 specified below was used instead of coating composition 1.

| Coating Composition 3 | |
|---|---|
| Resin C | 30 parts |
| Methyl ethyl ketone | 35 parts |
| Toluene | 35 parts |
| Silica | 0.05 part |

Here, the resin C is an epoxy resin having a weight per epoxy equivalent of 874 to 975. The resin C has the storage elasticity modulus at 130° C., $G'_{130}$, of 65 and the storage elasticity modulus at 200° C., $G'_{200}$, of 35, the ratio $G'_{130}/G'_{200}$ being 1.9.

WORKING EXAMPLE 4

An image receiving sheet was prepared in the same manner as in Working Example 1 except that a coating composition 4 specified below was used instead of coating composition 1.

| Coating Composition 4 | |
|---|---|
| Resin D | 30 parts |
| Methyl ethyl ketone | 35 parts |
| Toluene | 35 parts |
| Silica | 0.05 part |

Here, the resin D is a resin mixture composed of the polyester resin A and the epoxy resin C (1:1 by weight) described above. The resin D has the storage elasticity modulus at 130° C., $G'_{130}$, of 45 and the storage elasticity modulus at 200° C., $G'_{200}$, of 14, the ratio $G'_{130}/G'_{200}$ being 3.2.

Comparative Example 1

An image receiving sheet was prepared in the same manner as in Working Example 1 except that a coating composition 5 specified below was used instead of coating composition 1.

| Coating Composition 5 | |
|---|---|
| Resin E | 30 parts |
| Methyl ethyl ketone | 35 parts |
| Toluene | 35 parts |
| Silica | 0.05 part |

Here, the resin E is a polyester resin manufactured by Toyobo Co., Ltd. under the trade name "VYLON 200." The resin E has the storage elasticity modulus at 130° C., $G'_{130}$, of 64500 and the storage elasticity modulus at 200° C., $G'_{200}$, of 63, the ratio $G'_{130}/G'_{200}$ being 1020.

WORKING EXAMPLE 5

An image receiving sheet was prepared in the same manner as in Working Example 1 except that a coating composition 6 specified below was used instead of coating composition 1.

| Coating Composition 6 | |
|---|---|
| Resin F | 30 parts |
| Methyl ethyl ketone | 35 parts |
| Toluene | 35 parts |
| Silica | 0.05 part |

Here, the resin F is an epoxy resin manufactured by Yuka Shell Epoxy Inc. under the trade name "EPICOAT #1001." The resin F has a weight per epoxy equivalent of 450 to 500, the storage elasticity modulus at 130° C., $G'_{130}$, of 4, and the storage elasticity modulus at 200° C., $G'_{200}$, of 17, the ratio $G'_{130}/G'_{200}$ being 0.24.

EVALUATIONS

The image receiving sheets obtained in the working examples and the comparative example above were evaluated as follows.

Image Quality: An image of a color chart was formed on each of the image receiving sheets by an electrophotographic full-color printer specified below, and projected images from the respective image receiving sheets were produced by an overhead projector. These projected images were evaluated in terms of graying (a gray tone appearance) and color tone reproducibility.

Printer: In printing the full color chart on the respective image receiving sheets, a commercially available color laser printer was used. The printer used two toners described below and was modified so that the surface temperature of rollers can be monitored.

Toners: Toners $A_1$ and $A_2$ were used in the printer. The toner resin in toner $A_1$ had a storage elasticity modulus $G'_{A1}$ of 33 at 130° C. and 660 at 200° C. The toner resin in toner $A_2$ had a storage elasticity modulus $G'_{A2}$ of 10500 at 130° C. and 14500 at 200° C.

Recording conditions: The surface temperature of a fixing roller of the printer was 150° C. for the toner $A_1$, and 190° C. for the toner $A_2$. The linear pressure was set to 10 kg per the A4-size width, and silicone oil in the amount of 2 mg per A4-size was fed to the surface of the fixing roller. The recording was conducted at a rate of 3 ppm.

An image was electrophotographically recorded on each of the image receiving sheets of the working examples and the comparative example above. Based on he storage elasticity moduli $G'_{A1}$, $G'_{A2}$ of the toner resins and the storage elasticity modulus $G'_B$ of the resin binder of the receptor layer, the ratios $G'_{A1}/G'_B$ and $G'_{A2}/G'_B$ at temperatures ranging from 130° C. to 200° C. were respectively calculated and listed in Table 1.

TABLE 1

| | Resin binder of receptor layer | $G'_{A1}/G'_B$ | $G'_{A2}/G'_B$ |
|---|---|---|---|
| Working Example 1 | Resin A | 1.1 to 110 | 340 to 2400 |
| Working Example 2 | Resin B | 3.3 to 35 | 760 to 1050 |
| Working Example 3 | Resin C | 0.5 to 19 | 160 to 410 |
| Working Example 4 | Resin D | 0.1 to 0.2 | 2 to 70 |
| Comparative Example 1 | Resin E | $5.1 \times 10^{-4}$ to 10 | 0.16 to 230 |
| Working Example 5 | Resin F | 8.3 to 39 | 850 to 2600 |

Table 2 shows evaluation results of the projected images produced by the image receiving sheets of the working examples and the comparative example.

TABLE 2

| | Image Quality | |
|---|---|---|
| | Toner $A_1$ | Toner $A_2$ |
| Working Example 1 | ◎ | ○ |
| Working Example 2 | ◎ | ○ |
| Working Example 3 | ◎ | ◎ |
| Working Example 4 | ◎ | ◎ |
| Comparative Example 1 | X | ○ |
| Working Example 5 | ◎ | Δ |

Here, the evaluation notations are as follows:

◎: Clear projected image having a satisfactory color tone reproducibility with no recognizable gray tone in the highlight area of yellow;

○: Clear projected image having a satisfactory color tone reproducibility with almost no recognizable gray tone in the highlight area of yellow;

Δ: Almost clear projected image having an almost satisfactory color tone reproducibility, although it showed a slight gray tone in the highlight area of yellow;

×: Unclear projected image having a deteriorated color tone reproducibility with an apparent gray tone in the highlight area of yellow.

As shown in Table 2, it was confirmed that the image receiving sheet of the present invention has a superior image reproduction capability, and that the projected image is substantially free from graying.

It will be apparent to those skilled in the art that various modifications and variations can be made in the image receiving sheet and recording method of the present invention without departing from the spirit or scope of the invention. Thus, it is intended that the present invention cover the modifications and variations of this invention provided they come within the scope of the appended claims and their equivalents.

What is claimed is:

1. An image receiving sheet comprising:

a substrate; and a receptor layer over at least one side of said substrate, the receptor layer including a resin binder, the storage elasticity modulus of the resin binder being equal to or greater that $10^6$ Pa at temperatures below about 40° C. and substantially satisfying the following relationships:

$$G'_{130}/G'_{200} \leqq 9$$

and $$G'_{130} \leqq 10^3 \text{ Pa},$$

where $G'_{130}$ is the storage elasticity modulus of the resin binder at 130° C. and $G'_{200}$ is the storage elasticity modulus of the resin binder at 200° C.

2. The image receiving sheet according to claim 1, wherein said receptor layer has a thickness ranging from about 0.1 $\mu$m to about 10.0 $\mu$m.

3. The image receiving sheet according to claim 1, wherein the storage elasticity modulus $G'_A$ of a toner resin in a toner to be used for electropotographically recording images on the image receiving sheet and the storage elasticity modulus $G'_B$ of the resin binder in the receptor layer substantially satisfy the following relationship in a temperature range of about 130° C. to about 200° C.:

$$0.1 \leqq G'_A/G'_B \leqq 2500.$$

4. The image receiving sheet according to claim 1, further comprising at least one toner embedded into the receptor layer, the at least one toner forming an image pattern on the image receiving sheet, wherein the storage elasticity modulus $G'_A$ of a toner resin in the at least one toner and the storage elasticity modulus $G'_B$ of the resin binder in the receptor layer substantially satisfy the following relationship in a temperature range of about 130° C. to about 200° C.:

$$0.1 \leqq G'_A/G'_B \leqq 2500.$$

5. The image receiving sheet according to claim 1, wherein the substrate and the receptor layer are configured to have a total parallel ray transmittance equal to or greater than about 70%.

6. The image receiving sheet according to claim 1, further comprising a primer layer between the substrate and the receptor layer.

7. The image receiving sheet according to claim 1, further comprising an anti-static layer over the receptor layer.

8. The image receiving sheet according to claim 1, wherein the substrate is substantially transparent to visible light.

9. The image receiving sheet according to claim 1, wherein the resin binder in the receptor layer includes at least one of fillers, conductive substances, and peeling agents.

10. The image receiving sheet according to claim 1, further comprising a back layer on the back of the substrate.

11. The image receiving sheet according to claim 10, wherein the back layer is adapted to prevent curling of the image receiving sheet that may occur upon fixation of a toner on a receptor layer.

12. The image receiving sheet according to claim 10, wherein the back layer possesses an image receiving capability that is substantially the same as that of the receptor layer.

13. The image receiving sheet according to claim 1, wherein the receptor layer is formed on both of front and back sides of the substrate.

14. An image receiving sheet, comprising:

a substrate; and a receptor layer over at least one side of said substrate, the receptor layer including a resin binder, the storage elasticity modulus of the resin binder being equal to or greater than $10^6$ Pa at temperatures below about 40° C. and substantially satisfying the following relationships:

$$G'_{130}/G'_{200} \leqq 9$$

and $$G'_{130} \leqq 10^3 \text{ Pa},$$

where $G'_{130}$ is the storage elasticity modulus of the resin binder at 130° C. and $G'_{200}$ is the storage elasticity modulus of the resin binder at 200° C., and wherein said resin binder in the receptor layer includes at least one of a polyester resin having a bisphenol A skeleton and an epoxy resin.

15. A method for recording an image onto an image receiving sheet, the method comprising the steps of:

providing an image receiving sheet, the image receiving sheet including:

a substrate; and a receptor layer over at least one side of said substrate, the receptor layer including a resin binder, the storage elasticity modulus of the resin binder being equal to or greater than $10^6$ Pa at temperatures below about 40° C. and substantially satisfying the following relationships:

$$G'_{130}/G'_{200} \leqq 9$$

and $$G'_{130} \leqq 10^3 \text{ Pa},$$

where $G'_{130}$ is the storage elasticity modulus of the resin binder at 130° C. and $G'_{200}$ is the storage elasticity modulus of the resin binder at 200° C.;

transferring toner particles onto the receptor layer to form a pattern of the toner particles corresponding to the image to be recorded on the image receiving sheet; and embedding the toner particles into the reception layer at a predetermined fixing temperature to fix the toner particles to the image receiving sheet, the predetermined temperature being within the range of about 130° C. to about 200° C.

16. A method for recording an image onto an image receiving sheet, the method comprising the steps of:

providing an image receiving sheet, the image receiving sheet including a substrate and a receptor layer over at least one side of said substrate, the receptor layer including a resin binder;

transferring toner particles onto the receptor layer to form a pattern of the toner particles corresponding to the image to be recorded on the image receiving sheet, each of the toner particles including a toner resin; and embedding the toner particles into the reception layer at a predetermined fixing temperature to fix the toner particles to the image receiving sheet, wherein the storage elasticity modulus $G'_A$ of the toner resin in each of the toner particles and the storage elasticity modulus $G'_B$ of the resin binder in the receptor layer substantially satisfy the following relationship at the predetermined fixing temperature:

$$0.1 \leqq G'_A / G'_B \leqq 2500.$$

* * * * *